United States Patent [19]

Robert

[11] Patent Number: 4,860,837

[45] Date of Patent: Aug. 29, 1989

[54] ROTARY AND RECIPROCATING DRILLING MACHINE

[75] Inventor: Henri F. A. Robert, Herblay, France

[73] Assignee: Sorenam, Argences, France

[21] Appl. No.: 222,544

[22] Filed: Jul. 21, 1988

[30] Foreign Application Priority Data

Jul. 23, 1987 [FR] France ..... 87 10477

[51] Int. Cl.[4] ..... E21B 3/02; E21B 7/20

[52] U.S. Cl. ..... 175/113; 175/122; 175/161; 175/162; 175/171; 173/163; 173/165

[58] Field of Search ..... 175/114, 113, 121, 122, 175/161, 162, 170, 171, 195, 202, 203, 257, 173; 173/163, 165, 166; 464/163–166

[56] References Cited

U.S. PATENT DOCUMENTS

| | | | |
|---|---|---|---|
| 2,822,147 | 2/1958 | Allard | 175/161 |
| 3,420,320 | 1/1969 | Washita | 175/161 |
| 3,642,078 | 2/1972 | Dornfeld et al. | 175/171 |
| 3,685,596 | 8/1972 | Collins | 175/161 X |
| 3,734,204 | 5/1973 | Wallace | 173/165 X |
| 3,833,072 | 9/1974 | Back | 175/171 X |
| 3,869,003 | 3/1975 | Yamada et al. | 175/171 |
| 4,719,978 | 1/1988 | Klemm | 175/113 |

FOREIGN PATENT DOCUMENTS

| | | | |
|---|---|---|---|
| 0150977 | 8/1985 | European Pat. Off. | 175/195 |

*Primary Examiner*—Bruce M. Kisliuk

*Attorney, Agent, or Firm*—Allegretti & Witcoff, Ltd.

[57] ABSTRACT

The invention relates to a drilling machine comprising a kelly (5) suspended from a boom (3) mounted for pivoting on a chassis (1), a rotary table (7) through which the kelly is movable axially, drive members provided in the rotary table for rotating the kelly and a rotary drilling tool (8), more particularly a ground auger fixed to the bottom end of the kelly.

This machine is essentially characterized in that the rotary table (7) comprises at least two lateral protuberances (24) extending symmetrically with respect to the longitudinal axis of the kelly (5), in that the chassis (1) comprises two guide channels (26) disposed one opposite the other so as to receive the protuberances (24) and in that locking teeth (27) are provided for locking the protuberances (24) at any predetermined height in the guide channels (26).

The machine of the invention further comprises members for boring by reciprocating for reaching depths of about 80 to 100 meters.

10 Claims, 6 Drawing Sheets

ROTARY AND RECIPROCATING DRILLING MACHINE

The present invention relates to a drilling machine comprising a kelly suspended from a boom mounted for pivoting on a chassis, a rotary table through which the kelly is movable axially, drive members provided in the rotary table for rotating the kelly and a rotary drilling tool, more particularly a ground auger fixed to the bottom end of the kelly.

In drilling machines of this type, the rotary table must be rigidly joined to the boom so as to withstand the very high forces to which it is subjected during drilling operations. The need of such a connection is however not satisfactory. The torque generated by rotation of the kelly may in fact be transmitted in this way to the boom so that the drilling machine is constantly subjected to the action of forces tending to overturn it and preventing it from operating under good conditions.

The height of the rotary table above the ground in present day drilling machines is generally about ten meters. The existence of such a distance between the table and the ground has however the drawback not only of limiting the stability of the machine but also correspondingly reducing the possible drilling depth.

The present invention proposes overcoming the above mentioned drawbacks and, for this, provides a drilling machine of the above type which is characterized in that the rotary table comprises at least two lateral protuberances extending symmetrically with respect to the longitudinal axis of the kelly, in that the chassis comprises two guide channels disposed one opposite the other so as to receive the protuberances and in that locking means are provided for locking the protuberances at any predetermined height in the guide channels.

This set of arrangements, while preventing the torque generated by rotation of the kelly from being transmitted to the boom, transfers the overturning forces to the drilling axis and thus improves the operation of the machine. It further makes it possible to place the rotary table closer to the ground and correspondingly increase the depth of the holes drilled.

Advantageously, the locking means comprise racks provided on the facing faces of the guide channels, toothed members provided on the protuberances, whose teeth correspond to those of the racks, the toothed members being positioned so as to face the racks when the protuberances are inserted in the guide channels, and control means for providing relative movement between the racks and the toothed members so as to engage their teeth.

The rotary table may thus be locked rapidly and reliably at the level of the guide channels. Its height above the ground may in addition be readily adjusted depending on the conditions in which the holes are to be drilled.

In a preferred embodiment of the invention, the racks are secured to the facing faces of the guide channels whereas the toothed members are movable with respect to the racks. Furthermore, the control means are formed by jacks mounted back to back in the protuberances so as to move the toothed members in opposite directions.

For drilling holes slanted with respect to the vertical, the channels are carried by a cradle mounted for pivoting on a frame fixed to the chassis, about a horizontal axis perpendicular to the median longitudinal axis of the latter.

It is generally necessary to use a special tool, for example a drilling bit, for drilling in very hard rocks. Replacement of the usual drilling tool by the special tool however requires a great deal of time.

The present invention proposes providing a solution for this other problem and, for this, the boom comprises means for supporting a second tool, extending, like the kelly, in the median longitudinal plane of the chassis and is carried by a carriage movable thereover, parallel to its median longitudinal plane.

Thus it is sufficient to move the carriage over the chassis so as to bring, rapidly into the drilling axis, the tool which is to replace the one previously used.

Ground augers, which have the advantage of working rapidly, however cannot drill holes of more than 50 meters.

To fill this gap, the machine of the invention further comprises a reciprocating collar adapted for gripping a drill pipe whose axis is situated in the median longitudinal plane of the chassis, jacks for communicating a reciprocating circular movement to the reciprocating collar and to the drill pipe, jacks for driving the drill pipe into the ground while it describes its movement, and a retention collar for supporting the drill pipe when it is raised.

These different members of course widen the field of use of such a machine since they make it possible to drill holes reaching depths of 80 to 100 meters.

When the machine operates by reciprocating, the boom may advantageously support a grab bucket for removing the cuttings contained in the drill pipe.

One embodiment of the invention will be described hereafter by way of non limitative example with reference to the accompanying drawings in which.

Figure 1:
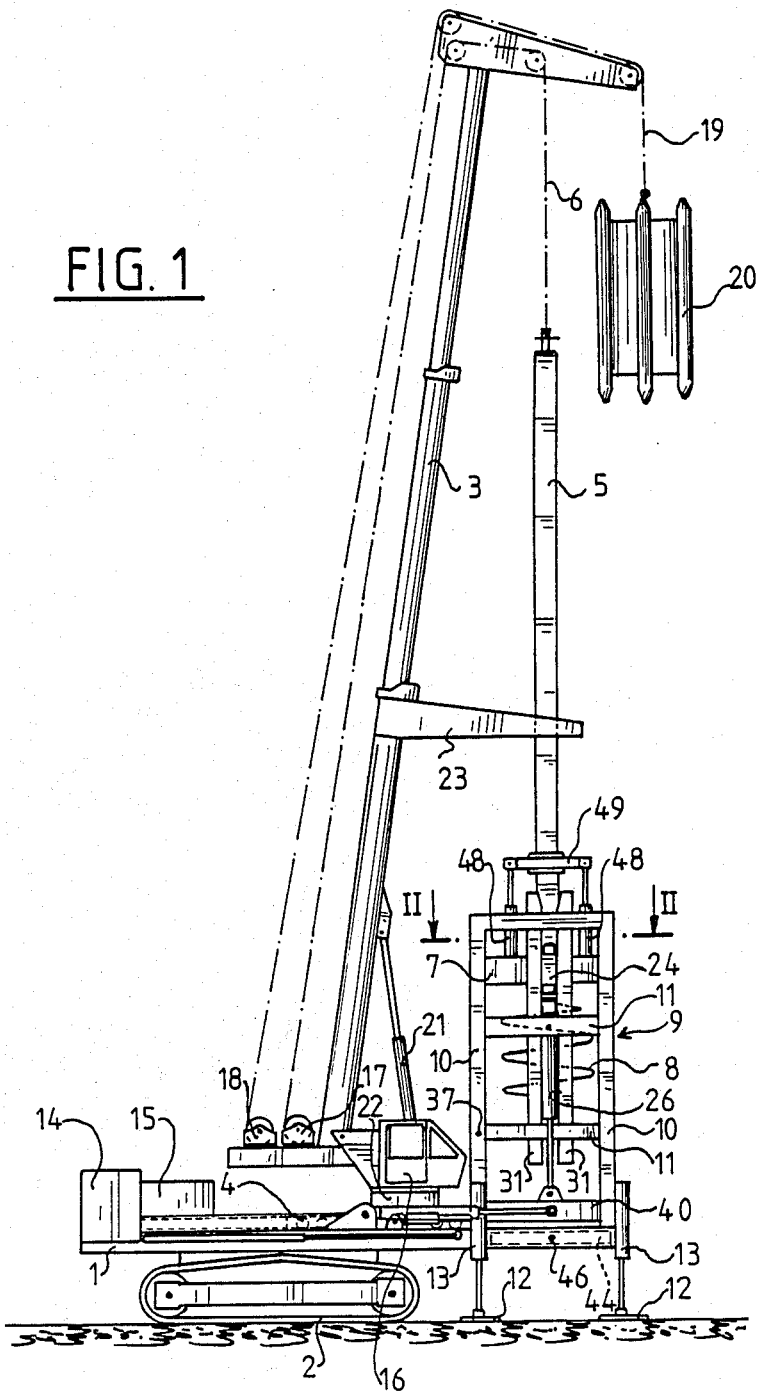
FIG. 1 is a schematic side view of a drilling machine of the invention, this machine being equipped with an auger and a drilling bit.

The drilling machine which can be seen in FIG. 1 comprises a chassis 1 resting on caterpillar tracks 2, a boom 3 mounted on a carriage 4 movable over the chassis 1, parallel to the longitudinal axis thereof, a kelly 5 suspended by a cable 6 from the upper end of the boom, a rotary table 7 through which the kelly is movable axially and an auger 8 installed at the lower end of the kelly.

Chassis 1 comprises a front frame 9 in the extension of its longitudinal sides, this frame being formed of uprights 10 connected together by spacers 11 and resting on the ground through shoes 12 controlled by hydraulic jacks 13. It further comprises, in a way known per se, a drive unit 14 and a central hydraulic unit 15.

As for carriage 4, it supports not only boom 3 but also a control cabin 16, a first winch 17 on the drum of which the cable 6 is wound and a second winch 18 whose cable 19 passes over the upper end of the boom and supports a drilling bit 20. It further includes a hydraulic jack 21 and a turret 22 for pivoting the first one in the median longitudinal plane of the chassis and the second about a vertical axis contained in this plane.

Boom 3 has on its front face a jib 23 for immobilizing the rotary table 7 (see FIG. 6) when the auger 8 is not used or when the operator causes boom 3 to pivot about the vertical axis for unloading the cuttings retained on the turns of the auger. It is formed of telescopic elements in the example shown but of course it could have a rigid structure.

Figure 2:
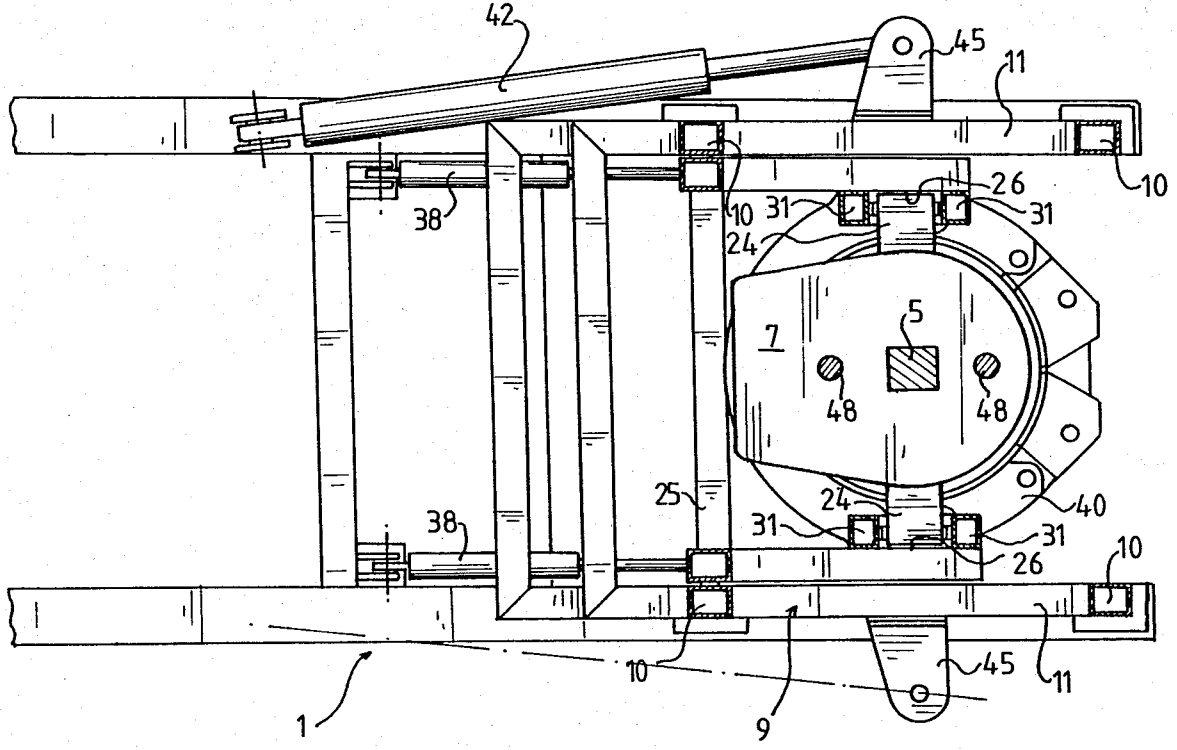
FIG. 2 is an enlarged sectional view through line II—II of FIG. 1.

In accordance with the invention, the rotary table 7 comprises two lateral protuberances 24 extending symmetrically with respect to the longitudinal axis of the kelly, on each side of the median longitudinal plane of the chassis. Furthermore, frame 9 supports on the inside a cradle 25, visible in FIGS. 2 and 5, comprising on the internal faces of its longitudinal sides, two guide channels 26 disposed opposite each other for receiving the protuberances. Locking means 27 are further provided for locking the protuberances 24 in the channels 26.

Figure 3:
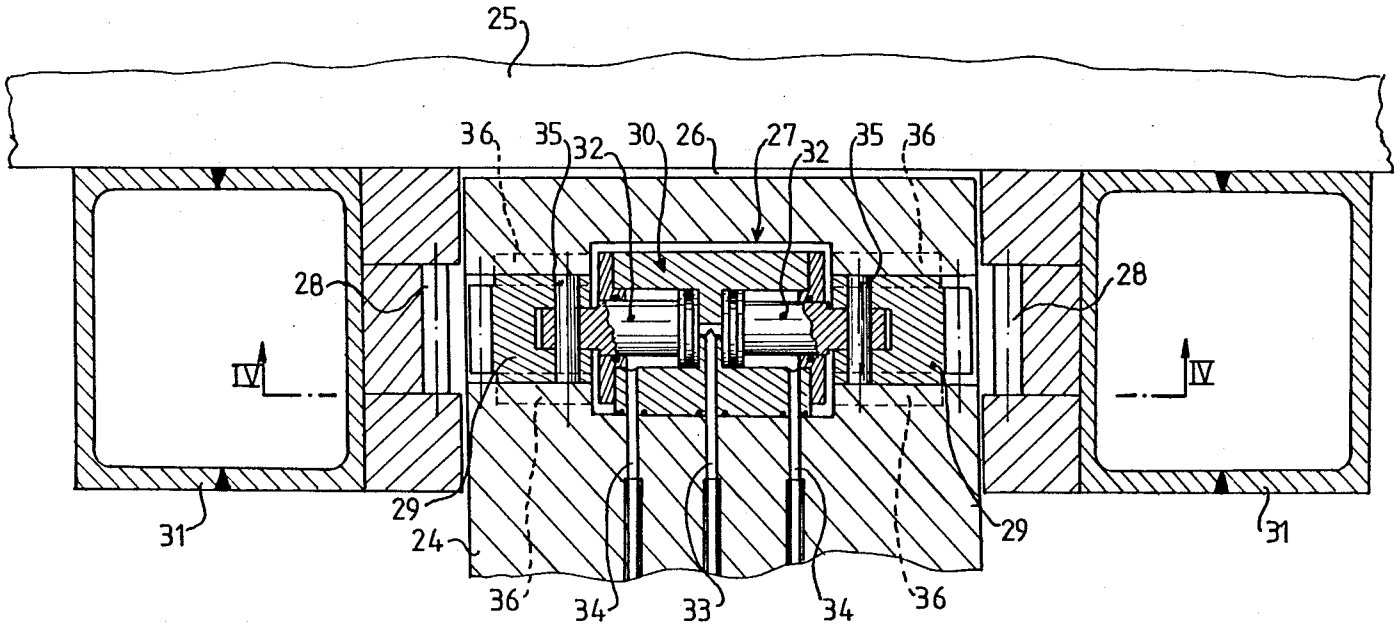
FIG. 3 is an enlarged horizontal sectional view taken at the level of the highest guide channel in FIG. 2.
Figure 4:
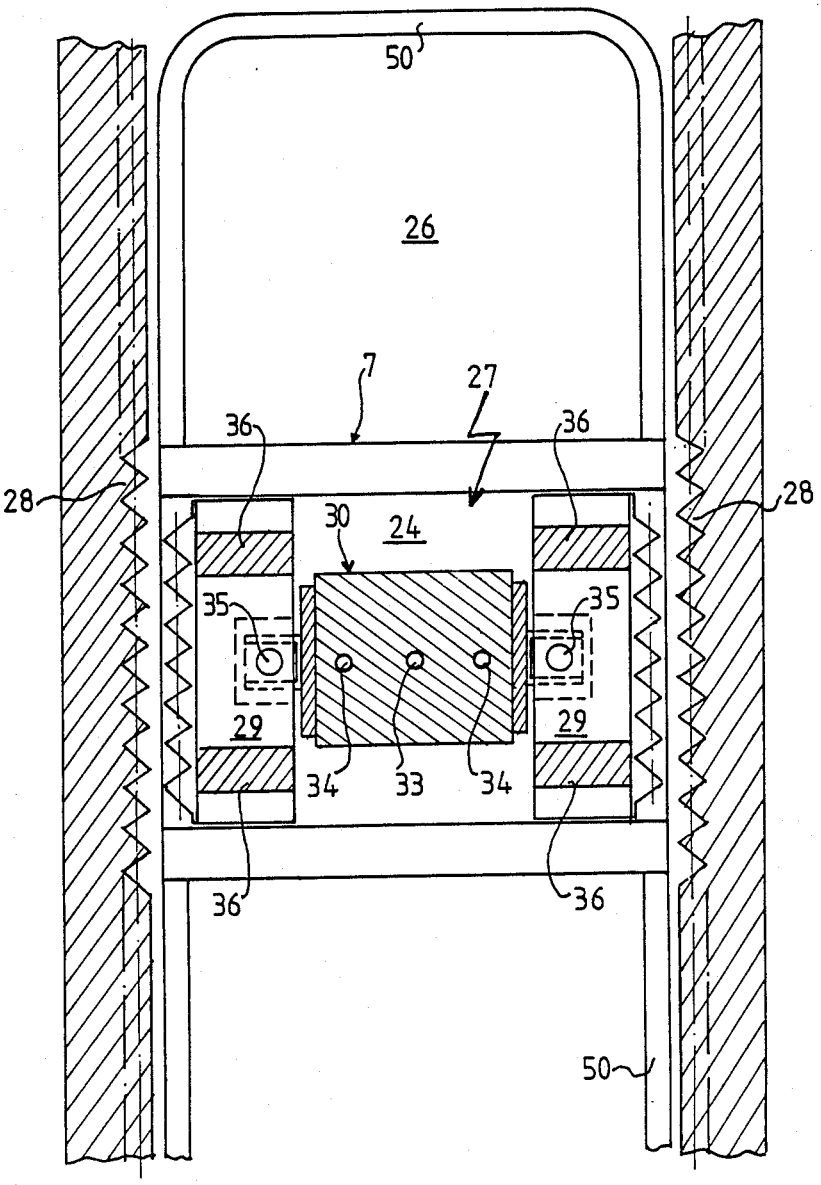
FIG. 4 is a sectional view through line IV—IV of FIG. 3.

As clearly shown in FIGS. 3 and 4, the locking means 27 comprise racks 28 fixed to the facing faces of channels 26, toothed members 29 housed in the faces of the protuberances 24 which are in front of the racks 28 when the rotary table is in position in the cradle, the teeth of the racks and of the toothed members being adapted so as to intimately fit into each other, and control means 30 adapted for moving the toothed members 29 with respect to the racks so as to lock the protuberances 24 in the guide channels 26 or unlock them.

In the example shown, channels 26 are each defined by two square section tubes 31 fixed parallel to each other on the internal faces of the longitudinal sides of the cradle and forming a space which widens progressively at their upper part (see FIGS. 1, 5 and 7) for facilitating introduction of the protuberances therebetween.

In addition, the control means 30 are formed by jacks 32 mounted back to back in the protuberances 24 and adapted for moving the two toothed members 29 of the same protuberance in opposite directions.

Jacks 32 are adapted to be connected to a pressurized fluid source, not shown, by a single pipe 33 opening into their chamber at the bottom side or by two pipes 34 opening into their chamber on the rod side. Their rod is coupled to the corresponding toothed member by means of a pin 35, for applying the toothed members 29 against racks 28 when a pressurized fluid is fed into their bottom-side chamber or moving them away from the racks when the pressurized fluid is fed into their rodside chamber.

The toothed members 29 are guided in their movement by keys 36, visible in FIGS. 3 and 4, these keys being housed in complementary cavities formed in the facing faces of the protuberances 24 and of the toothed members movable therein.

The drilling machine of the invention may be used for drilling holes slanted with respect to the vertical. For this, its cradle 25 is mounted on frame 9 for pivoting about a horizontal pin 37 perpendicular to the median longitudinal plane of chassis 1 and may pivot under the control of two jacks 38 extending perpendicularly to pivot pin 37.

Figure 5:
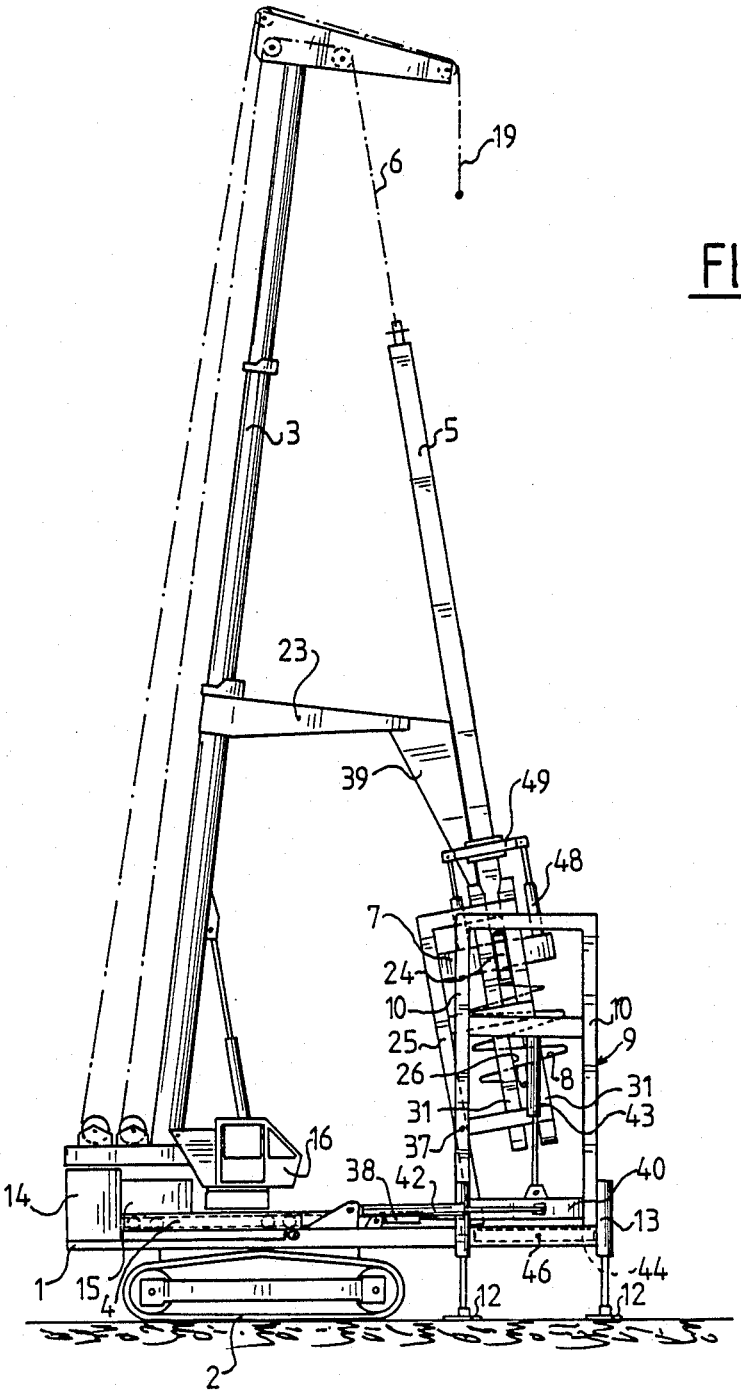
FIG. 5 is a view similar to FIG. 1, but showing the machine in a position for drilling a hole which is slanted with respect to the vertical.

Referring more particularly to FIG. 5, it can be seen that jacks 38 are mounted for pivoting to chassis 1 by the bottom of their cylinder and to the lower end of the rear transverse side of cradle 25 by the free end of their piston rod. It will also be noted that pivot pin 37 bears on the rear uprights 10 of frame 9, above the connection of jacks 38 with cradle 25. It will be further noted that a support 39 has been provided at the free end of jib 23 for supporting kelly 5 when the auger 8 is raised from the bottom of the drill-hole.

To drill a slanting hole, the protuberances 24 of the rotary table 7 should be locked in the guide channels 26 of cradle 25 which has previously been disposed vertically, jacks 38 controlled so as to give the desired slant to the cradle, and the carriage 4 moved over chassis 1 from the position shown in FIG. 1 to its position shown in FIG. 5 whilst the cradle is slanted leftwards. It will be noted here that there is no need to move carriage 4 when the cradle is slanted to the right.

The machine of the present invention may be further used for drilling holes by reciprocating. For this, in a way known per se, it comprises a reciprocating collar 40 adapted for gripping a drill pipe 41, two reciprocating jacks 42 for imparting a reciprocating circular movement to collar 40 and pipe 41, two working jacks 43 mounted for pivoting on the longitudinal sides of frame 9 and from which the collar 40 is suspended and a retention collar 44 for supporting pipe 41 when it is raised from the drill-hole.

The reciprocating collar 40, whose axis is situated in the median longitudinal plane of chassis 1, is situated below the lower end of the guide channels 26 of cradle 25 and is lockable on pipe 41 by hydraulic jacks not shown. It may further be open at the level of its portion which is directed towards the front transverse sides of cradle 25 and frame 9, for facilitating the positioning of pipe 41 in collar 40 as well as removal of said pipe. It is moreover for this purpose that cradle 25 and frame 9 are also open at the level of their front transverse sides (see FIG. 2).

The drill pipe 41 is conventional and does not need to be described here. It is simply provided with a cutting unit at its lower end and is formed of sections joined together as they are driven into the ground.

In so far as the reciprocating jacks 42 are concerned, they are interposed between chassis 1 and two lugs 45 causing the reciprocating collar to project from the longitudinal sides of the frame.

As for the retention collar 44, it is mounted on the longitudinal side of frame 9 for pivoting about a horizontal axis 46 and is lockable on pipe 41 by hydraulic jacks not shown. Like the reciprocating collar 40, it may be open at the level of its portion which is directed towards the front transverse sides of cradle 25 and the frame, also for facilitating positioning and removal of pipe 41.

A hydraulic control, not shown, is provided for preventing the retention collar from opening before locking of the reciprocating collar on the drill pipe, and conversely, so as to prevent the drill pipe from falling to the bottom of the drill-hole when it is raised.

Figure 6:
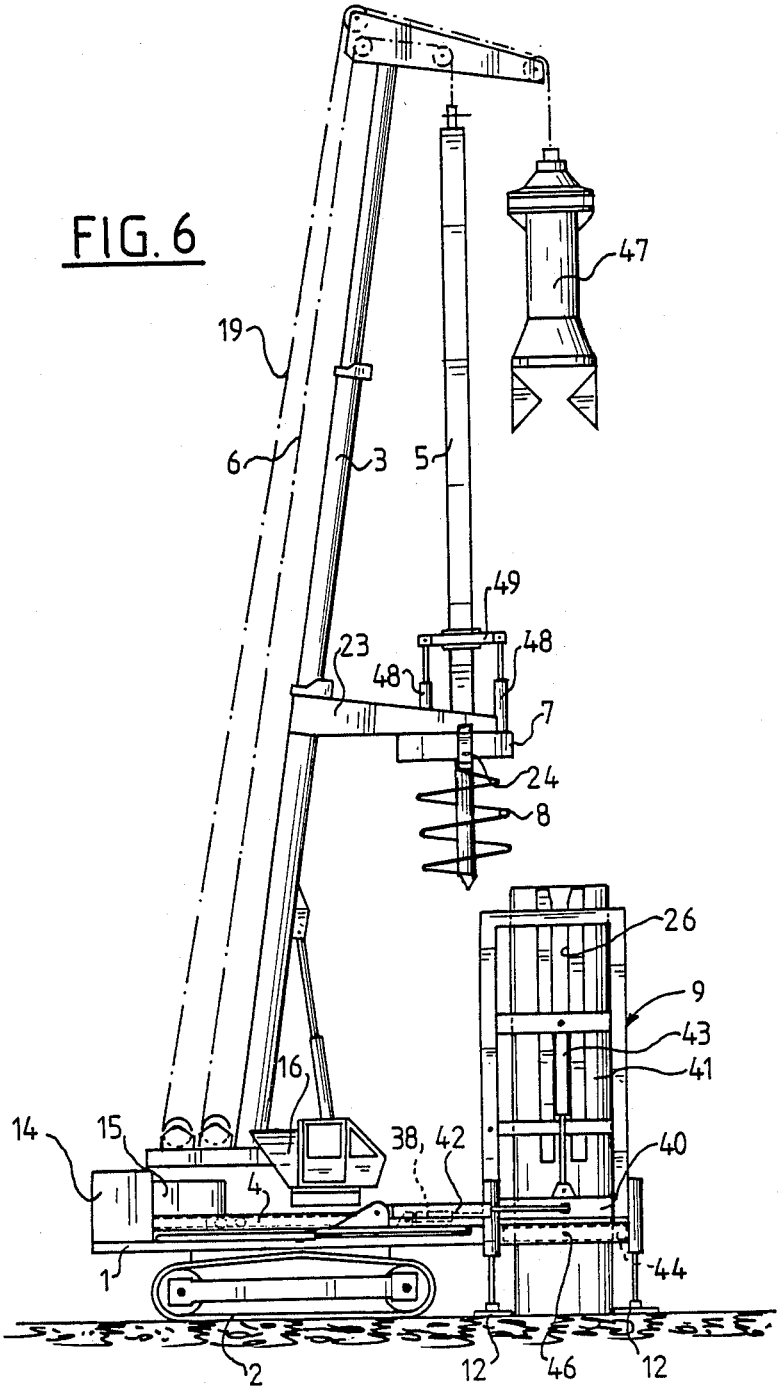
FIG. 6 is a schematic side view showing the machine in FIG. 1 when it is used for drilling a hole by reciprocating.

The drilling machine further comprises a grab 47 for removing the cuttings which accumulate in the drill pipe 41. This grab, which can be seen in FIG. 6, is coupled to the free end of cable 19 and must extend coaxially with pipe 41 in which it is necessary to introduce it for removing the cuttings.

Finally, the following information will be given:

kelly 5 is formed by a square section rod but, for drilling holes which may reach 50 meters or so, it could be formed of several telescopic elements, rotation of the kelly is provided in a way known per se by two hydraulic motors, not shown, housed in the rotary table, two vertical jacks 48 situated on each side of the kelly 5 are interposed in a way known per se between the upper part of the rotary table 7 and an annular support 49 surrounding the kelly, for transmitting to the auger the force for penetrating into the ground, and the protuberances 24 of the rotary table are provided on their upper and lower faces with hoops 50 (see FIG. 4) adapted for cooperating with racks 28 for improving guiding of the rotary table during its movement along the channels 26.

The operation of the machine of the invention will now be described when it is used with an auger and assuming that at the outset the rotary table 7 is immobilized against the lower face of jib 23. The operations to be carried out in this case are the following:

the slant of the boom is adjusted so that kelly 5 is coaxial with the hole to be drilled;

winch 17 is actuated for lowering the rotary table 7 inside cradle 25 so that the protuberances 24 advance in the guide channels 26;

pressurized fluid is fed into the bottomside chambers of jacks 32 so as to engage the toothed members 29 with racks 28 and lock the rotary table 7 in cradle 25;

the hydraulic motors controlling the rotation of kelly 5 are actuated;

winch 17 is actuated for lowering the auger 8 to the level of the ground; and jacks 48 are actuated for forcing the auger into the ground.

Then, when the amount of cuttings accumulated between the turns of the auger is sufficient, the hydraulic motors rotating the kelly are stopped, pressurized fluid is fed into the rod-side chambers of the jacks 32 so as to disengage the toothed members 29 from racks 28 and unlock the rotary table 7, winch 17 is actuated for raising the rotary table up to its rest position against jib 23, boom 3 is rotated through about 90° about the vertical axis of turret 22 for unloading the cuttings, and the hydraulic motors controlling rotation of the kelly are again actuated for ejecting the cuttings from the turns of the auger.

Of course, the set of above described operations will need to be repeated so as to reach the maximum depth of about 50 meters.

If, during drilling, the auger met very hard rocks, the drilling bit 20 could advantageously be used. It would in fact be sufficient to immobilize the rotary table 7 against the lower face of the jib and to move the carriage 4 over the frame 1 of the crane so as to position the drilling bit in the axis of the drill-hole, which would require very little time.

To reach a depth of 80 to 100 meters, the drilling should be continued by reciprocating. For this, it is sufficient to immobilize the rotary table 7 against jib 23, to adjust the position of carriage 4 on chassis 1 so as to bring grab 47 into the axis of the drill-hole, to position the drill pipe 41 in the usual way, and actuate the members required for reciprocating.

I claim:

1. Drilling machine comprising a kelly (5) suspended from a boom (3) mounted for pivoting on a chassis (1), a rotary table (7) through which the kelly is movable axially, drive members provided in the rotary table for rotating the kelly and a rotary drilling tool (8) fixed to a bottom end of the kelly, characterized in that the rotary table (7) comprises at least two protuberances (24) extending symmetrically with respect to the longitudinal axis of the kelly (5), in that the chassis (1) comprises two guide channels (26) disposed one opposite the other so as to receive the protuberances (24) and in that locking means (27) are provided for locking the protuberances (24) at any predetermined height in the guide channels (26), said channels (26) being carried by a cradle (25) mounted on a frame (9) fixed to the chassis (1) for pivoting about a horizontal axis perpendicular to the median longitudinal axis thereof.

2. Drilling machine according to claim 1, characterized in that the locking means (27) comprise racks (28) with guide channels (26) on their facing faces, toothed members (29) provided on the protuberances (24), whose teeth correspond to teeth of the racks, the toothed members (29) being positioned so as to face the racks (28) when the protuberances (24) are inserted in the guide channels (26), and control means (30) for causing a relative movement between the racks (28) and the toothed members (29) so as to engage their teeth.

3. Drilling machine according to claim 2, characterized in that said racks (28) are fixed to the facing faces of the guide channels (26) whereas the toothed members (29) are movable with respect to the racks (28).

4. Drilling machine according to claim 2 or 3, characterized in that the control means (30) are formed by jacks mounted back to back in the protuberances (24) so as to move the toothed members (29) in opposite directions.

5. Drilling machine according to claim 1, characterized in that the boom (3) has means (19) for supporting a second tool (20) extending, like the kelly (5), in the median longitudinal plane of the chassis (1), and is carried by a carriage (4) movable thereover, parallel to the median longitudinal plane of said chassis.

6. Drilling machine according to claim 1, characterized by a reciprocating collar (40) adapted for gripping a drill-pipe (41) whose axis is situated in the median longitudinal plane of the chassis (1), jacks (42) for communicating a reciprocating circular movement to the reciprocating collar (40) and to the drill-pipe (41), jacks (43) for driving the drill-pipe (41) into the ground while it describes its movement and a retention collar (44) for supporting the drill-pipe (41) when it is raised.

7. Drilling machine according to claims 5 and 6, characterized in that the boom (3) is provided for supporting a grab (47) for removing the cuttings contained in the drill-pipe (41).

8. Drilling machine according to claim 1, characterized in that the chassis (1) rests on displacement means (2), particularly caterpillar tracks.

9. Drilling machine according to claim 1 wherein the rotary drilling tool (8) comprises a ground auger.

10. Drilling machine according to claim 1 wherein said protuberances (24) extend perpendicularly to the longitudinal axis of said chassis (1).

* * * * *